US011583755B1

(12) United States Patent
Zhu

(10) Patent No.: US 11,583,755 B1
(45) Date of Patent: Feb. 21, 2023

(54) ELECTRIC ROLLER SKATE AND CONTROL METHOD THEREOF

(71) Applicant: SHENZHEN DBS TECHNOLOGY CO., LTD., Shenzhen (CN)

(72) Inventor: MingCong Zhu, Shenzhen (CN)

(73) Assignee: SHENZHEN DBS TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 17/405,039

(22) Filed: Aug. 18, 2021

(30) Foreign Application Priority Data

Jul. 27, 2021 (CN) ..... 202121726264.7

(51) Int. Cl.
*A63C 17/12* (2006.01)
*A63C 17/06* (2006.01)
*A63C 17/26* (2006.01)

(52) U.S. Cl.
CPC ..... *A63C 17/12* (2013.01); *A63C 17/06* (2013.01); *A63C 17/26* (2013.01); *A63C 2203/12* (2013.01); *A63C 2203/18* (2013.01); *A63C 2203/22* (2013.01); *A63C 2203/24* (2013.01)

(58) Field of Classification Search
CPC ..... A63C 17/12; A63C 17/06; A63C 17/26; A63C 2203/12; A63C 2203/18
See application file for complete search history.

(56) References Cited

U.S. PATENT DOCUMENTS 4,546,841 A * 10/1985 Sipiano ..... A63C 17/26 180/181
5,236,058 A * 8/1993 Yamet ..... A63C 17/12 280/11.208
5,390,941 A * 2/1995 Pozzobon ..... A63C 17/12 280/11.221
5,797,466 A * 8/1998 Gendle ..... A63C 17/265 180/181
5,829,543 A * 11/1998 Diaz ..... A63C 17/12 180/181
6,428,050 B1 * 8/2002 Brandley ..... A63C 17/12 280/809
7,204,330 B1 * 4/2007 Lauren ..... A63C 17/12 180/181
2017/0182397 A1 * 6/2017 Zhang ..... A63C 17/12
2018/0015353 A1 * 1/2018 Green ..... A63C 17/226
2019/0168105 A1 * 6/2019 Hilt ..... F16H 7/06
2022/0062743 A1 * 3/2022 Zhang ..... A61B 5/112

* cited by examiner

*Primary Examiner* — Brian L Swenson

(57) ABSTRACT

An electric roller skate in the present invention includes a shoe body, a roller frame, a driver, a rotation speed detection device, and a controller. The controller receives rotation speed information of the rotation speed detection device and accordingly controls the driver to start to drive the rollers to rotate. The present invention further provides a control method for the electric roller skate described above. The controller is capable of controlling the driver to start to drive the electric roller skate to slide according to the detected rotation speed information. Through the above arrangement, the solution can help a user to skate in a more labor-saving manner and reduce fatigue of the user. Meanwhile, the driver is started in a mode closer to a conventional sliding mode, is higher in convenience and intelligence, reduces use difficulty and makes user experience better.

10 Claims, 3 Drawing Sheets

ELECTRIC ROLLER SKATE AND CONTROL METHOD THEREOF

TECHNICAL FIELD

The present invention belongs to the technical field of roller skates, and particularly relates to an electric roller skate and a control method therefor.

BACKGROUND

Roller skates are commonly known as roller skating shoes and have a certain fitness and entertainment function. As a leisure article in life, they are well received by vast consumers. Meanwhile, along with the development of the times and the demands of different consumer groups, electric roller skates are researched and developed gradually in the market. Such roller skates have a relatively high speed and can save more strength for users, so they serve as a relatively convenient means of transport.

Existing electric roller skates still have great deficiency in the control over sliding although they can achieve effects of saving strength and reducing fatigue of users. Typically, the existing electric roller skates are started or stopped when a human body applies loads to sensing switches of shoe bodies. It is difficult for beginners to learn this control mode. Meanwhile, this control mode cannot be changed any time according to sliding conditions of the users due to the not high intelligence degree, resulting in relatively poor user experience.

SUMMARY

To overcome the defects in the prior art, objectives of the present invention are to provide an electric roller skate with a more novel and intelligent control mode, and a control method for the electric roller skate.

One of the objectives of the present invention is achieved by the technical solutions as below.

An electric roller skate includes:

a shoe body;

a roller frame, disposed on the shoe body, where the roller frame is provided with no less than two rollers;

a driver, configured to drive at least one roller to rotate;

a rotation speed detection device, configured to detect a roller rotation speed of the rollers; and a controller, electrically connected to both the driver and the rotation speed detection device, where the controller receives rotation speed information of the rotation speed detection device and accordingly controls the driver to start to drive the rollers to rotate.

Further, the electric roller skate further includes an idling detection device configured to detect whether the rollers are idling, the idling detection device is electrically connected to the controller, and the controller receives idling information of the idling detection device and accordingly controls the driver to stop driving the rollers.

Further, the idling detection device is a distance measurement device configured to measure a height from the rollers to the ground, the distance measurement device is electrically connected to the controller, and the controller receives distance measurement information of the distance measurement device and accordingly controls the driver to stop driving the rollers.

Further, the idling detection device is a load detection device configured to detect a load at the bottom of the shoe body, the load detection device is disposed at the bottom of the shoe body and electrically connected to the controller, and the controller receives load information of the load detection device and accordingly controls the driver to stop driving the rollers.

Further, the electric roller skate further includes a remote control device for manual operation, the remote control device is electrically connected to the controller, and the controller is capable of receiving a control instruction from the remote control device and accordingly controls the driver to act.

The other of the objectives of the present invention is achieved by the technical solutions as below.

A control method for the electric roller skate described above includes:

applying sliding force to the electric roller skate to drive the electric roller skate to slide; and when the rotation speed detection device detects that a sliding speed of the electric roller skate reaches a designated speed, controlling, by the controller, the driver to start to drive the electric roller skate to slide.

Further, the method further includes:

when rollers are in a state leaving the ground; and when the idling detection device detects that the rollers are idling, controlling, by the controller, the driver to stop driving the electric roller skate.

Further, after the idling detection device detects that the electric roller skate has been idling for a specified period of time, the controller controls the driver to stop driving the electric roller skate.

Further, the idling detection device is a distance measurement device, and after the distance measurement device detects that the electric roller skate is in a suspended state for a specified period of time, the controller controls the driver to stop driving the electric roller skate.

Further, the idling detection device is a load detection device, and after the load detection device detects that no load is applied to a shoe sole of the electric roller skate within a specified period of time, the controller controls the driver to stop driving the electric roller skate.

Compared with the prior art, the present invention have the beneficial effects as below.

As a user skates using the electric roller skate of the present invention, when the rotation speed detection device detects that a sliding speed reaches a specified speed, the controller may receive rotation speed information and controls the driver to start, to provide certain sliding boost to help the user to skate forwards. The present invention further provides a control method for the electric roller skate described above. The controller is capable of controlling the driver to start to drive the electric roller skate to slide according to the rotation speed information of the rotation speed detection device. Through the above arrangement, the solution can help the user to skate in a more labor-saving manner and reduce fatigue of the user. Meanwhile, the driver is started in a mode closer to a conventional sliding mode, is higher in convenience and intelligence, reduces use difficulty and makes user experience better.

1. Roller frame; 11. Roller; 12. Hole site; 2. Shoe body; and 3. Battery.

DESCRIPTION OF EMBODIMENTS

The following further describes the present invention with reference to the accompanying drawings and the specific implementations. It should be noted that the various embodiments or technical features described hereinafter may be combined randomly to form novel embodiments on the premise of no conflicts.

Figure 2:
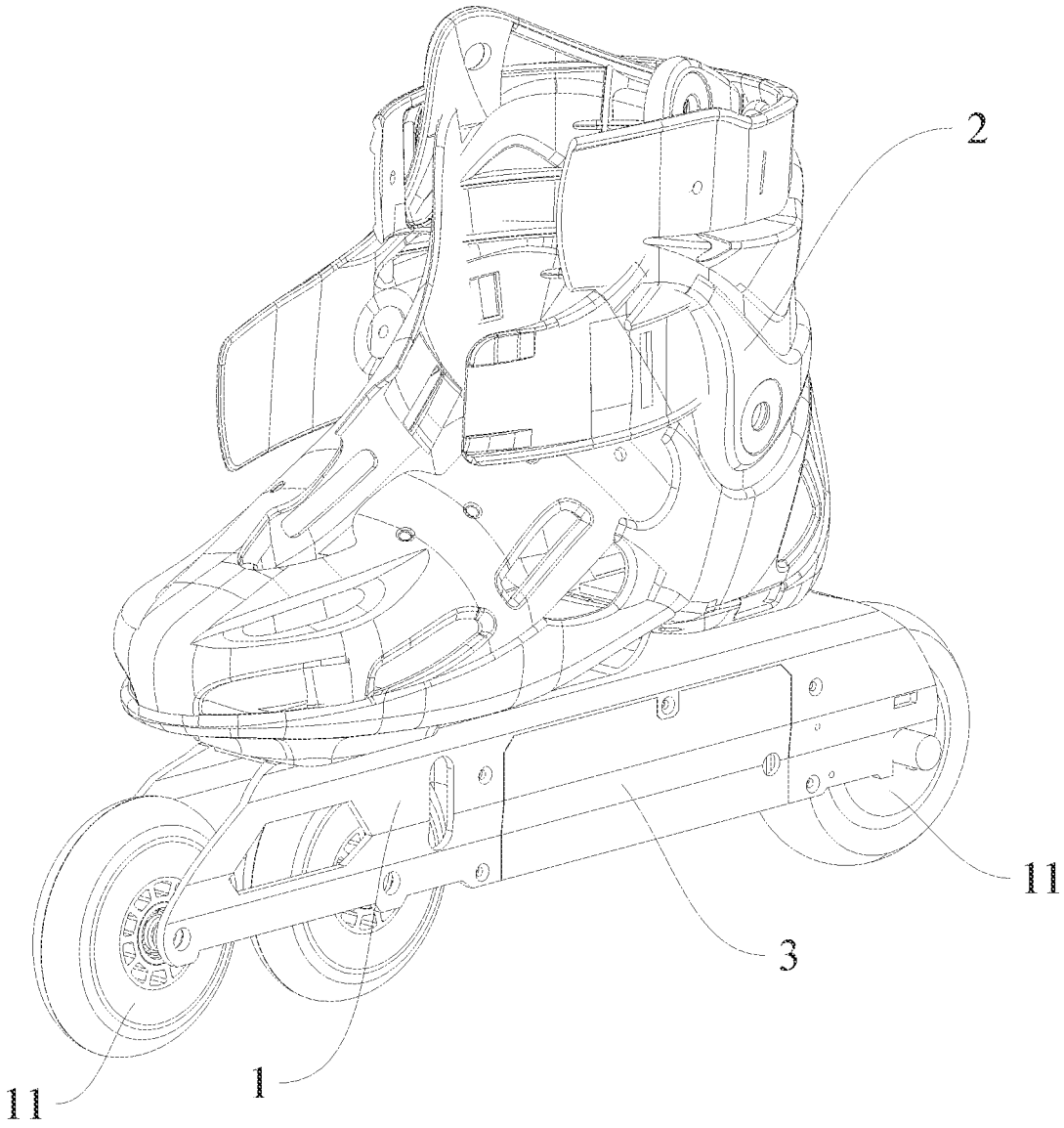
FIG. 2 is a schematic structural diagram of a preferred implementation of a roller frame and rollers of the present invention.

The present invention discloses an electric roller skate. Referring to FIG. 2, the electric roller skate includes: a shoe body 2, a roller frame 1 detachably connected to the shoe body 2, a driver configured to drive at least one roller 11 to rotate, a rotation speed detection device configured to detect a roller 11 rotation speed of the rollers 11, and a controller electrically connected to both the driver and the rotation speed detection device. The roller frame 1 is provided with no less than two rollers 11. The controller receives rotation speed information of the rotation speed detection device and accordingly controls the driver to start to drive the rollers 11 to rotate. When the solution is used, a user may skate using the rollers 11 once selecting shoe bodies 2 that fit and wearing them. As the user skates, when the rotation speed detection device detects that a sliding speed reaches a specified speed, the controller receives rotation speed information and controls the driver to start, to provide certain sliding boost to help the user to skate forwards. Through the above arrangement, the solution can help the user to skate in a more labor-saving manner and reduce fatigue of the user. Meanwhile, the driver is started in a mode closer to a conventional sliding mode, is higher in convenience and intelligence, reduces use difficulty and makes user experience better.

In this embodiment, a combination of the controller and the rotation speed detection device provides a boost mode for the electric roller skate. When the user uses the electric roller skates, a certain speed is provided by sliding of feet. When the rotation speed detection device detects an initial speed of sliding at the moment, the controller controls the driver to start and keep the power, to drive a motor wheel to rotate for forward sliding. Through the above arrangement, the driver is started in a more convenient and intelligent mode than a conventional starting mode and can provide boost for the user in the sliding process and reduce fatigue of the user.

Meanwhile, the controller can further realize a speed control function in combination with the rotation speed detection device. After the user skates by two feet by turns according to the acceleration process described above, the electric roller skates can speed up continuously. Once the rotation speed detection device detects the maximum speed as specified in system at the moment, the controller controls the driver to keep the current speed instead of speeding up. At the moment, there is no need to provide boost for sliding of feet, only the electric roller skates need to keep in contact with the ground all the time. The driver drives the rollers 11 to slide forwards at the current speed. Finally, the rotation speed detection device and the controller can further decelerate or stop the driver. When the user does deceleration actions in the sliding process, at the moment, the rotation speed detection device can detect that the electric roller skate has a trend of speeding down. Then, the controller controls the driver to decelerate or even stop, to improve sliding safety.

In this embodiment, the electric roller skate further includes an idling detection device configured to detect whether the rollers 11 are idling, the idling detection device is electrically connected to the controller, and the controller receives idling information of the idling detection device and accordingly controls the driver to stop driving the rollers 11. Through the combination of the idling detection device and the controller, the electric roller skate can take speed-down actions. When the user needs to speed down, the electric roller skate can be lifted to leave the ground. At the moment, the idling detection device can detect that the rollers 11 of the electric roller skate are in an idling state. After the user continues to keep the state for a period of time, the controller controls the driver to decelerate to stop, such that the electric roller skate is safer to use. This mode of controlling the electric roller skate to stop sliding is more convenient and simpler than a conventional mode, better conforms to use conditions of the user, and makes user experience better.

In particular, there are several implementation solutions of the idling detection device in the present invention, and among which, two feasible implementations are provided below. The first implementation: the idling detection device is a distance measurement device configured to measure a height from the rollers 11 to the ground, the distance measurement device is electrically connected to the controller, and the controller receives distance measurement information of the distance measurement device and accordingly controls the driver to stop driving the rollers 11. In this implementation, the distance measurement device can detect the height from the electric roller skate to the ground in real time when the user skates. After it is detected that one arbitrary electric roller skate is in a suspended state and keeps the state for a certain period of time, the controller receives information to control the driver to stop running, to achieve a deceleration effect.

The second implementation: the idling detection device is a load detection device configured to detect a load at the bottom of the shoe body 2, the load detection device is disposed at the bottom of the shoe body 2 and electrically connected to the controller, and the controller receives load information of the load detection device and accordingly controls the driver to stop driving the rollers 11. In this implementation, the load detection device detects whether the electric roller skate is in a load state. When the user lifts up and suspends one arbitrary electric roller skate, at the moment, the foot does not form load on the shoe body 2. At the moment, after the load detection device detects that the electric roller skate is not in a load state for a period of time, the controller receives information to control the driver to stop running, to achieve a deceleration effect. In other embodiments, the idling detection device may further be another idling detection device.

In this embodiment, the electric roller skate further includes a remote control device for manual operation and the controller electrically connected to the remote control device and the driver, and the controller is capable of receiving a control instruction from the remote control device and accordingly controls the driver to act. Through the above arrangement, a remote manual control function is added to the electric roller skate. The user can manually operate the remote control device (including an acceleration function and a deceleration function), and deliver a corresponding instruction to the controller through the remote control device, and then the controller controls the driver to achieve acceleration or deceleration actions. Therefore, the user controls the speed of the electric roller skate more intelligently and conveniently. In use, when the user turns on the remote control device, the electric roller skate automatically switches to a remote control mode from a boost mode, and when the user turns off the remote control device, the electric roller skate automatically switches to a boost mode from a remote control mode, making operation experience better.

Figure 1:
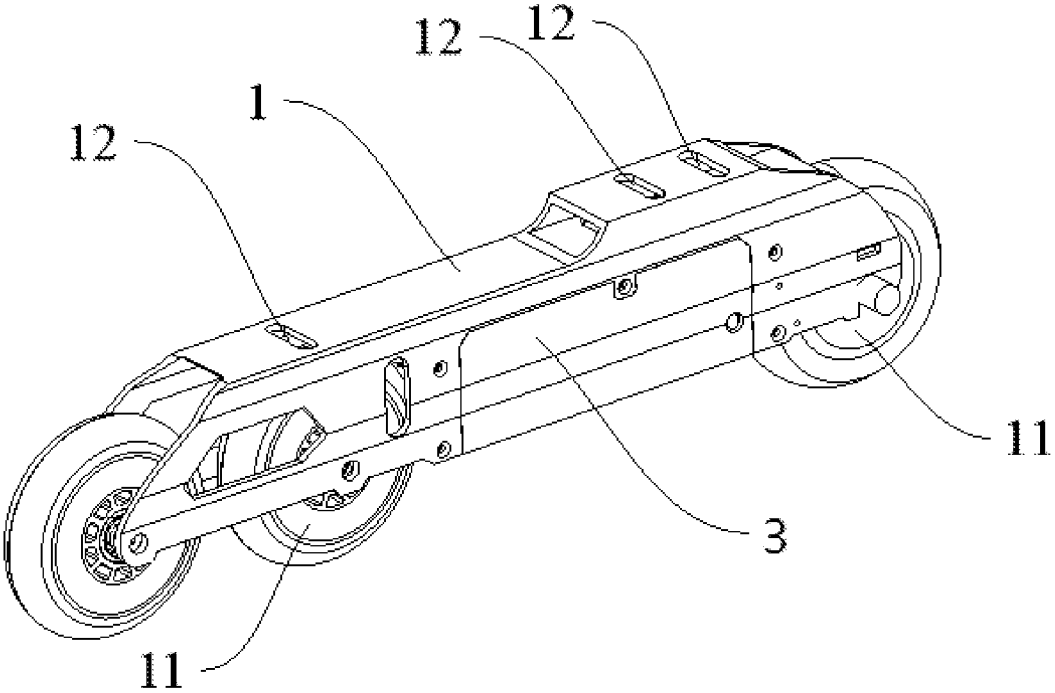
FIG. 1 is a schematic structural diagram of a preferred implementation of an electric roller skate of the present invention.

In this embodiment, the shoe body 2 and the roller frame 1 are detachably connected (refer to FIG. 1). Therefore, the user can have electric roller skates of different sizes or types only by purchasing one pair of roller 11 skates and then purchasing different shoe bodies 2 as needed. Not only can expenditure of the user be reduced, but also refitting probability can be increased, such that the electric roller skate has a wider consumer range, to meet the customized requirements of different consumers.

In this embodiment, the roller frame 1 is detachably connected to the shoe body 2 through a screw connection structure. This connection mode can ensure the firm connection of the shoe body 2 and the roller frame 1, meanwhile the screw connection mode is simple and convenient to operate, and every user can detach and replace them on one's own. In other embodiments, the connection mode between the shoe body 2 and the roller frame 1 may further be snap fit connection.

In this embodiment, the screw connection structure includes a plurality of hole sites 12 provided on the roller frame 1 and used to be connected with screws, and all the hole sites 12 are dispersed along the roller frame 1. One hole site 12 is located at a front end of the roller frame 1, and the other hole sites 12 are provided on a rear end of the roller frame 1 at intervals. With this arrangement, the roller frame 1 can be stably connected to shoe bodies 2 of different specifications or types. (Since the shoe bodies 2 of different types and specifications are different in size, screw connection positions at their bottoms are different; this problem can be well solved because the plurality of hole sites 12 are provided on the roller frame 1.)

In this embodiment, the hole sites 12 are further designed into strip-shaped hole sites 12. With this arrangement, the hole sites 12 and screws can be conveniently aligned and adjusted, such that the shoe body 2 and the roller frame 1 are mounted more conveniently.

In this embodiment, the electric roller skate further includes the driver configured to drive at least one roller 11 and a battery 3 configured to supply power to the driver. In particular, the roller 11 with the driver is an electric roller, and the other rollers are ordinary rollers. With this arrangement, the electric roller skate has external driving force, so as to save more strength in skating and improve user experience.

Accordingly, the roller frame 1 of this embodiment is provided with a battery holder configured to place the battery 3 and the controller, and the battery 3 and the controller are detachably disposed in the battery holder. The battery 3 is detachably disposed, such that the user can detach the battery 3 without needing external driving force, reducing the weight of the electric roller skate. The user can also carry several backup batteries 3 for standby use when needing the driver to provide auxiliary power, greatly prolonging the runtime.

Figure 3:
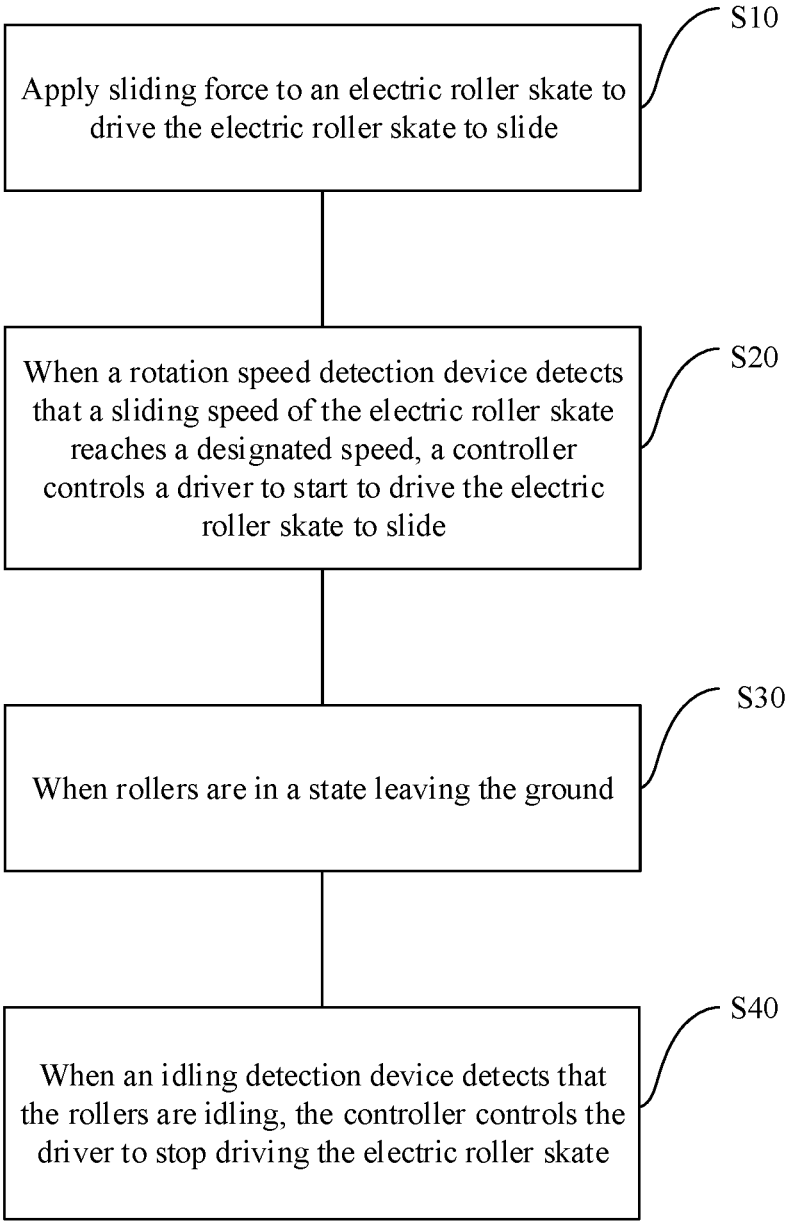
FIG. 3 is a flowchart of a control method for a preferred implementation of an electric roller skate of the present invention.

The present invention further provides a control method for the electric roller skate described above (refer to FIG. 3). The control method includes the steps below.

S10. After wearing the electric roller skate, a user applies sliding force to the electric roller skate to drive the electric roller skate to slide, such that the electric roller skate acquires an initial speed. The sliding force in this embodiment may be manual skating strength of the user or driving force from others, etc.

S20. As the user skates, when the rotation speed detection device detects that a sliding speed of the electric roller skate reaches a designated speed, the controller controls the driver to start and keep the power according to the rotation speed information, to drive the electric roller skate to slide forwards, and in this way to provide sliding boost for the user. In this embodiment, the magnitude of the designated speed may be adjusted and changed according to different specific users and different use conditions.

Except for the above steps for starting the driver, the control method further includes the following steps to start or stop the driver, such that the control over the whole electric roller skate is more complete, and the user can control the driver to start or stop on one's own.

S30. As the user skates, when the driver in the electric roller skates has already been started, the user lifts up one arbitrary electric roller skate to leave the ground, such that the rollers 11 of this electric roller skate are in an idling state. In this embodiment, the idling detection devices may be disposed in two electric roller skates respectively, or the idling detection device may only be disposed in the electric roller skate corresponding to the preferred foot of the user, to save the cost.

S40. After the user lifts up one arbitrary electric roller skate, the idling detection device detects that the electric roller skate is being in an idling state, then the controller controls the driver to stop according to the idling information, and at the moment, the electric roller skate no longer provides power for assisting the user in skating, such that the sliding speed of the electric roller skate can be reduced, and the user can stop at a target location when no longer skating.

To more accurately judge the use intention of the user, the above control method for stopping the driver is set as below. After the idling detection device detects that the electric roller skate is in an idling state for a period of time, the controller controls the driver to stop driving the electric roller skate. By adding the judgment basis lasting for a period of time, the controller can be prevented from judging the normal lifting action of the foot of the user in skating as the information for stopping the driver, such that the control method is more intelligent to control and conforms to actual use conditions. Likewise, this period of time may be adjusted and set according to actual use conditions of different users. Typically, this period of time is set to be longer than the normal lifting time of the foot of the user in skating.

It can be learned according to the above situation that in this embodiment, the idling detection device functions to detect whether the rollers 11 are in an idling state, and there are several types of devices having this function. In the present invention, two feasible implementations of the control method are provided below.

The first implementation: the idling detection device is a distance measurement device, and the distance measurement device may detect a distance from the electric roller skate to the ground and then judge whether the electric roller skate is in a suspended state. When the user lifts up one arbitrary electric roller skate, the distance measurement device detects that the electric roller skate is in a suspended state, and after the user keeps for a period of time, the controller controls the driver to stop driving the electric roller skate according to detection information of the distance measurement device. Likewise, in this implementation, the distance measurement devices may be disposed in the two electric roller skates respectively, or the distance measurement device may only be disposed in the electric roller skate corresponding to the preferred foot of the user.

The second implementation: the idling detection device is a load detection device, and the load detection device is configured to detect whether a load is applied to the electric roller skate. After the user lifts up one arbitrary electric roller skate, the foot of the user does not apply a load to the lifted electric roller skate. After the load detection device detects that the electric roller skate keeps the state for a period of time (lifts the foot for a period of time), then the controller controls the driver to stop driving the electric roller skate according to detection information. Likewise, in this implementation, the load detection devices may be disposed in the two electric roller skates respectively, or the load detection device may only be disposed in the electric roller skate corresponding to the preferred foot of the user.

The above implementations are merely preferred implementations of the present invention, and thus may not limit the protection scope of the present invention. Any insubstantial variations and replacements made by those skilled in the art based on the present invention all fall within the protection scope of the present invention.

What is claimed is:

1. An electric roller skate, comprising:

a shoe body;

a roller frame, disposed on the shoe body, wherein the roller frame is provided with no less than two rollers;

a driver, configured to drive at least one roller to rotate;

a rotation speed detection device, configured to detect a roller rotation speed of the rollers;

a controller, electrically connected to both the driver and the rotation speed detection device, wherein the controller receives rotation speed information of the rotation speed detection device and accordingly controls the driver to start to drive the rollers to rotate; and an idling detection device configured to measure a height from the rollers to the ground;

wherein the idling detection device is a distance measurement device electrically connected to the controller; and the controller receives distance measurement information of the distance measurement device and accordingly controls the driver to stop driving the rollers.

2. The electric roller skate according to claim 1, further comprising a remote control device for manual operation, wherein the remote control device is electrically connected to the controller, and the controller is capable of receiving a control instruction from the remote control device and accordingly controls the driver to act.

3. A control method for an electric roller skate, used to control the electric roller skate according to claim 1, comprising:

applying sliding force to the electric roller skate to drive the electric roller skate to slide; and when the rotation speed detection device detects that a sliding speed of the electric roller skate reaches a designated speed, controlling, by the controller, the driver to start to drive the electric roller skate to slide.

4. The control method according to claim 3, further comprising:

when the rollers are in a state leaving the ground; and when the idling detection device detects that the rollers are idling, controlling, by the controller, the driver to stop driving the electric roller skate.

5. The control method according to claim 4, wherein after the idling detection device detects that the electric roller skate has been idling for a specified period of time, the controller controls the driver to stop driving the electric roller skate.

6. The control method according to claim 4, wherein after the distance measurement device detects that the electric roller skate is in a suspended state for a specified period of time, the controller controls the driver to stop driving the electric roller skate.

7. An electric roller skate, comprising:

a shoe body;

a roller frame, disposed on the shoe body, wherein the roller frame is provided with no less than two rollers;

a driver, configured to drive at least one roller to rotate;

a rotation speed detection device, configured to detect a roller rotation speed of the rollers;

a controller, electrically connected to both the driver and the rotation speed detection device, wherein the controller receives rotation speed information of the rotation speed detection device and accordingly controls the driver to start to drive the rollers to rotate; and an idling detection device configured to detect a load at the bottom of the shoe body;

wherein the idling detection device is a load detection device; the load detection device is disposed at the bottom of the shoe body and electrically connected to the controller; and the controller receives load information of the load detection device and accordingly controls the driver to stop driving the rollers.

8. A control method for the electric roller skate according to claim 7, comprising:

applying sliding force to the electric roller skate to drive the electric roller skate to slide; and when the rotation speed detection device detects that a sliding speed of the electric roller skate reaches a designated speed, controlling, by the controller, the driver to start to drive the electric roller skate to slide.

9. The control method according to claim 8, further comprising:

when the rollers are in a state leaving the ground; and when the idling detection device detects that the rollers are idling, controlling, by the controller, the driver to stop driving the electric roller skate.

10. The control method according to claim 9, wherein after the load detection device detects that no load is applied to a shoe sole of the electric roller skate within a specified period of time, the controller controls the driver to stop driving the electric roller skate.

* * * * *